US005167907A

United States Patent [19]

Mauget et al.

[11] Patent Number: 5,167,907

[45] Date of Patent: Dec. 1, 1992

[54] PROCESS FOR PLUGGING A TUBE OF A STRAIGHT-TUBE HEAT EXCHANGER

[75] Inventors: Christian Mauget, Marcy L'Etoile; Benoit Giraud, Lyon, both of France

[73] Assignee: Framatome, Courbevoie, France

[21] Appl. No.: 742,000

[22] Filed: Aug. 8, 1991

[30] Foreign Application Priority Data

Aug. 8, 1990 [FR] France ..... 90 10137

[51] Int. Cl.[5] ..... G21C 19/00; F28F 11/00

[52] U.S. Cl. ..... 376/260; 376/286; 29/890.031; 285/19

[58] Field of Search ..... 376/203, 204, 286, 260; 29/890.031, 402.08, 402.09, 402.11; 165/76; 122/DIG. 14; 138/91, 97, 98, 109; 285/19, 20, 187

[56] References Cited

U.S. PATENT DOCUMENTS

| | | | |
|---|---|---|---|
| 2,344,698 | 3/1944 | Howe | 285/19 |
| 3,962,767 | 6/1976 | Byerley et al. | 29/890.031 |
| 4,081,325 | 3/1978 | Aubert et al. | 376/204 |
| 4,413,765 | 11/1983 | Tracy | 29/890.031 |
| 4,941,512 | 7/1990 | McParland | 29/402.11 |

FOREIGN PATENT DOCUMENTS

| | | |
|---|---|---|
| 0321317 | 6/1989 | European Pat. Off. . |
| 2282097 | 3/1976 | France . |
| 2423843 | 11/1979 | France . |

OTHER PUBLICATIONS

"Research Disclosure" 181-May 1979, GB, (18146), p. 211.

*Primary Examiner*—Daniel D. Wasil

*Attorney, Agent, or Firm*—Pollock, Vande Sande & Priddy

[57] ABSTRACT

The tube (4) to be plugged is cut at its ends adjacent to the first and to the second branch (14, 15) and the metal of the junction zones (16, 16') of the tube (4) with each of the branches (14, 15) is eliminated. At least one portion of the tube (4) adjacent to at least one of the branches (14, 15) is cut and eliminated. Into each of the ends of the tube (4) in place inside the heat exchanger is introduced a plug (24, 30) of tubular shape, the diameter of which is smaller than the inside diameter of the tube (4), so that the plug has a closed end (**24*a*, 30*a*) inside the tube (4) and an opposite end located inside the corresponding branch (14, 15). The plugs (24, 30) are fixed in place in the branches (14, 15), and a continuous sealing weld is made between each of the plugs (24, 30) and the corresponding branch (14, 15), the tube (4) having some freedom of movement in the longitudinal direction in relation to the plugs (24, 30**).

7 Claims, 5 Drawing Sheets

PROCESS FOR PLUGGING A TUBE OF A STRAIGHT-TUBE HEAT EXCHANGER

FIELD OF THE INVENTION

The invention relates to a process for plugging tube of a straight-tube heat exchanger comprising two tube plates which are substantially parallel and distant from one another and through which pass orifices in the region of which the tubes are fastened at their ends.

The invention is used particularly for a straight-tube steam generator of a fast-neutron nuclear reactor cooled by a liquid metal, such as sodium.

BACKGROUND OF THE INVENTION

There are known steam generators of fast-neutron nuclear reactors cooled by a liquid metal, which comprise a bundle consisting of a set of parallel straight tubes fastened at their ends in tube plates parallel to one another and fixed to the outer casing of the steam generator. The tube plates delimit, within the casing of the steam generator, three successive zones of which the first forms a water box, the second a zone for the circulation of the heat-exchange liquid metal in contact with the outer surface of the tubes of the bundle, and the third a steam collector.

The tube plates are pierced over their entire thickness with holes, in the region of each of which the end of a tube is fastened by welding to a connecting branch of tubular shape which projects relative to the inner face of the tube plate, this connecting branch generally being designated by the term "nipple" in the relevant art.

Each of the tubes of the bundle of the heat exchanger is fastened at one of its ends to a first branch of a first tube plate and at its other end to a second branch of a second tube plate, the inside diameter of the second branch and of the corresponding orifice of the second tube plate being substantially larger than the outside diameter of the tube which is connected to the second branch by means of a junction zone of frustoconical shape.

Each of the tubes thus makes the junction between the water box and the steam collector, the feed water of the steam generator, distributed throughout the set of tubes of the bundle at the outlet of the water box, subsequently being heated and evaporated within the tubes as a result of thermal contact with the liquid heat-exchange metal. The steam formed in the tubes is thereafter recovered in the steam collector.

The hot liquid sodium is generally conveyed to the upper part of the steam generator in the vicinity of the tube plate delimiting the steam collector; the liquid sodium subsequently circulates vertically on the outside of the tubes of the bundle.

Should one of the tubes have a crack causing a leak, this leak must be detected very quickly, so that the operation of the steam generator can be stopped and its emptying carried out before the reaction between the liquid sodium and the water flowing off via the leak reaches such a stage that the steam generator may be damaged and this reaction no longer controlled by the safety devices provided on the steam generator and ensuring the damping of pressure waves in the sodium.

A leak in the region of one of the tubes of the steam generator can be disclosed either by detection of the hydrogen forming as a result of the reaction of the water with the sodium or by acoustic detection of the noise of the reaction.

After the steam generator has been emptied completely, it is necessary to carry out a repair on the defective tube having a leak, either by plugging or by the replacement of this defective tube, in order to make it possible for the steam generator to be put back into operation.

To effect the plugging of a defective tube of a steam generator, various techniques, such as those described, for example, in the patents FR-A-2,524,609 and FR-A-2,560,962, are available.

In FR-A-2,524,609, it is proposed to carry out the plugging of the tube by means of an automatic displacement of a shutter placed inside the tube, so as to obtain the shutting off of this tube, under the effect of the pressure difference accompanying the occurrence of the leak and the succeeding reaction between the sodium and water. This plugging of the tube makes it possible to prevent the leak from having harmful consequences by separating the pressurized water or steam from the sodium safely and immediately.

FR-A-2,560,962 recommends plugging by the installation of a flexible sleeve in an axial arrangement inside the tube, this sleeve being fastened by mechanical keying or by blast welding.

In actual fact, the plugging techniques employing expanding sleeves, shutters or the fastening of a shutoff member by expansion, blast welding or keying are no longer adopted in operations for the maintenance or repair of steam generators using liquid sodium as a primary fluid. Indeed, it is necessary to guarantee that there is absolute sealing between the water and the liquid sodium during operation. None of the abovementioned techniques makes it possible to guarantee such absolute sealing.

In fact, the operation of a steam generator of a fast-neutron nuclear reactor results in very high temperatures of the heat-exchange fluid ensuring the heating and evaporation of the water, in extremely rapid transient temperature effects and in thermal shocks attributable to temperature variations, which can be very great, of the liquid metal constituting the heat-exchange fluid.

Moreover, the proportion of tubes shut off during successive repair operations on a steam generator must not exceed a particular percentage of the tubes as a whole.

It is generally considered that this percentage must be between 10 and 15% of the tubes.

The disadvantage of the technique of plugging the tubes is that it causes a loss of power of the steam generator and introduces a temperature asymmetry into the bundle of tubes, with the result that the other tubes of the bundle experience increased thermomechanical stresses.

Furthermore, for safety reasons, it is not possible to place plugs o the outer walls of the tube plates of a steam generator, i.e., those facing the water box or facing the steam collector. In fact, in this case, hydrogen detection or acoustic detection making it possible to reveal the occurrence of a leak of water or steam into the sodium cannot be conducted reliably and quickly. Belated detection of a water leak into the sodium has very serious disadvantages as mentioned above.

It is inadvisable to make welds on the tube plates which are liable to induce welding stresses in these plates and make it necessary to relieve the tube plates of stress after welding and to carry out checking procedures which are difficult to perform.

The plugs for shutting off the tubes must therefore be placed on the inner walls of the tube plates, i.e., the walls facing the zone of the steam generator containing the tube bundle. The tube plates have thicknesses which can be relatively large, for example of the order of 400 mm, and therefore the plugs have to be placed on walls located at considerable distances from the outer access faces of the tube plates.

Should the cutting and extraction of the defective tube be carried out before the plugging of the corresponding orifices of the tube plates is executed, the thermohydraulic behavior of the steam generator is modified inasmuch as the extraction of the defective tube modifies the circulation of the cooling fluid in the hydraulic channel located between the tubes adjacent to the defective tube.

Should plugging be carried out without the extraction of the defective tube from the steam generator, this tube is liable to dilate and experience buckling deformation during the operation of the nuclear reactor. The defective tube can come into contact with the adjacent tubes and cause damage to these tubes by friction under the effect of the vibrations generated by the flow of the heat-exchange fluid.

SUMMARY OF THE INVENTION

It is therefore an object of the invention to provide a process for plugging a tube of a straight-tube heat exchanger comprising, two plates which are substantially parallel and spaced from one another and through which pass orifices in the region of which the tubes are fastened at their ends by welding to connecting branches, each of the tubes of the bundle of the heat exchanger being fastened at one of its ends to a first branch of a first tube plate and at its other end to a second branch of a second tube plate, this process making it possible to carry out effective and reliable plugging from outside the steam generator and to overcome the disadvantages of the processes of the prior art.

To this end:

- the cube is cut at its end adjacent to the first and to the second branch, and the metal of the junction zones of the tube with each of the branches is eliminated from inside the tube and through either one of the tube plates,
- at least one portion of the tube adjacent to at least one of the branches is cut and eliminated,
- into each of the ends of the tube in place inside the heat exchanger is introduced a tubular plug, the diameter of which is smaller than the inside diameter of the tube, so that the plug has a closed end inside the tube and an opposite end located inside the corresponding branch,
- the plugs are fixed in place in the branches, and a continuous sealing weld is made between each of the plugs and the corresponding branch inside each of the branches, the tubes having some freedom of movement in the longitudinal direction in relation to the plugs.

BRIEF DESCRIPTION OF THE DRAWINGS

To make it easy to understand the invention, a plurality of embodiments of the plugging process according to the invention used for a steam-generator tube of a fast-neutron nuclear reactor cooled by liquid sodium will now be described by way of example with reference to the accompanying drawings.

DESCRIPTION OF THE PREFERRED EMBODIMENT

Figure 1:
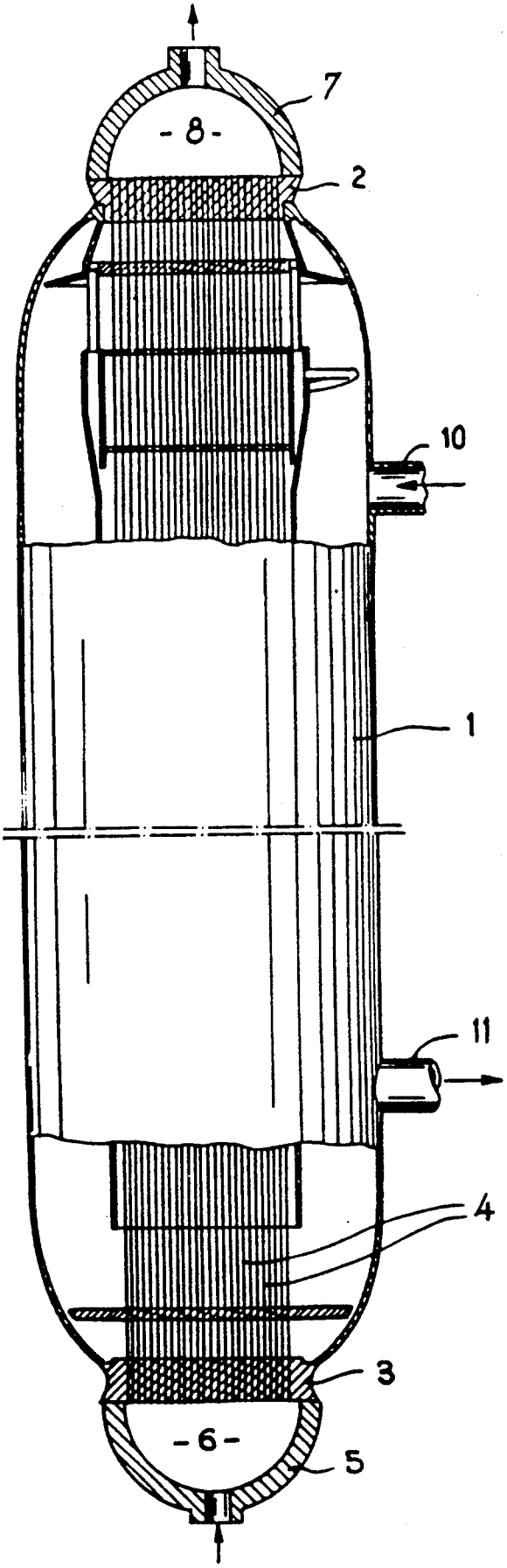
FIG. 1 is a partially sectional elevation view of a straight-tube steam generator of a fast-neutron nuclear reactor.

FIG. 1 shows a straight-tube steam generator comprising an outer casing 1 and two tube plates 2 and 3 fastened to the casing at its respective upper and lower ends. The tube plates 2 and 3 are pierced with holes over their entire thickness, and straight parallel tubes 4 are arranged between the two plates 2 and 3 in the extension of the holes passing through these plates. The lower plate 3 delimits with a hemispherical casing 5 a water box 6 communicating with the inlet ends of the tubes 4. The plate 2 delimits with a hemispherical casing 7 a steam collector 8 in communication with the outlet ends of the tubes 4. Between the water box 6 and the steam collector 8, the outer casing 1 of the steam generator delimits the zone in which circulates the liquid heat-exchange metal, such as liquid sodium, entering the casing 1 by way of a pipe 10 and leaving the casing by way of a pipe 11.

Water is introduced into the water box 6, which ensures that it is distributed in the tubes 4 of the bundle. The water circulates in the tubes from the bottom upwards, is heated and evaporates under the effect of the heat given off by the liquid heat-exchange metal. The steam formed is recovered in the collector 8.

Figure 2:
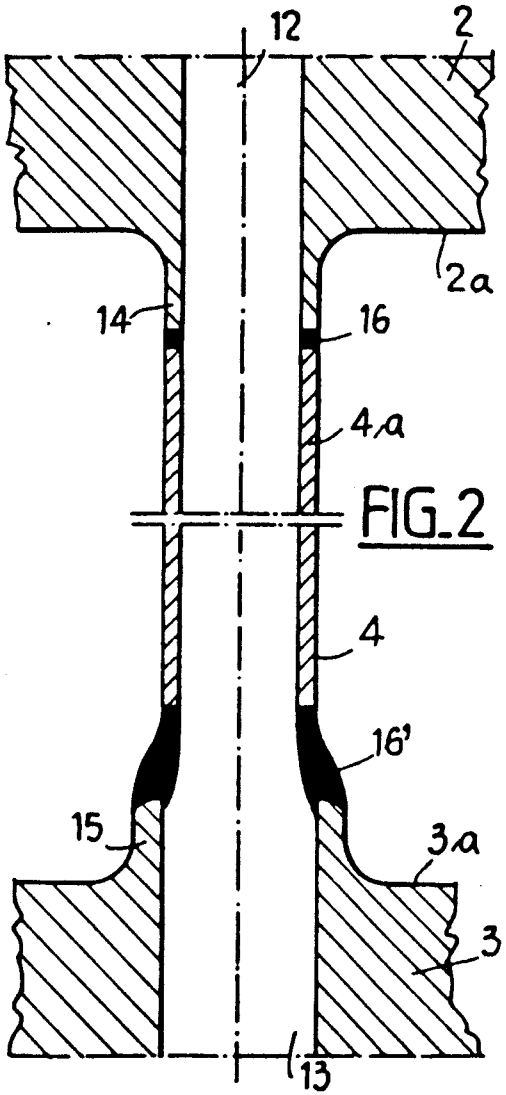
FIG. 2 is a sectional view of a steam-generator tube, showing particularly the ends of the tube connected respectively to the first tube plate on the same side as the steam collector and to the second tube plate on the same side as the water box of the steam generator.

FIG. 2 shows the ends of a tube 4 of the bundle in the region of the junction zones with the upper tube plate 2 and with the lower tube plate 3, respectively. The junction is made by means of tubular branches 14 and 15 of the respective plates 2 and 3, projecting relative to the inner faces 2*a* and 3*a* of these tube plates. The branches 14 and 15 called "nipples", are arranged so as to surround the outlet end of an orifice 12 or 13 of the corresponding tube plate 2 or 3 on the faces 2*a* and 3*a*.

The diameter of the hole 13 passing through the plate 3 and the inside diameter of the bore of the nipple 15 are slightly larger than the outside diameter of the tube 4, of which the installation in the bundle can be carried out via the tube plate 3 before the installation of the casing 5 of the water box 6. The upper end 4*a* of the tube 4 is fastened to the end of the nipple 14 by butt welding, the junction being made by means of a weld of annular shape 16.

The lower part of the tube 4 is connected to the nipple 15 by means of a junction zone and a weld 16' of substantially frustoconical shape made by the fusion of the end of the tube 4 engaged over a short length inside the nipple 15 and of the end of the nipple 15.

FIGS. 3A, 3B, 3C and 3D illustrate a tube 4 having a crack causing a leak, the plugging of which is carried out by means of the process according to the invention.

The corresponding elements in FIG. 2 and in FIGS. 3A, 3B, 3C and 3D bear the same references.

The plugging of the tube 4 is carried out on the steam generator after emptying of the liquid sodium, steam and water, cooling of the steam generator and dismounting of the outer walls 5 and 7 of the water box 6 and of the steam collector 8, respectively.

Thus, the outer face of the tube plates 2 and 3 is accessible, thereby making it possible to introduce into the tube to be dismounted, via the passage orifices of the plates 2 and 3, the tools necessary for cutting and/or machining of the tube 4 of which the plugging and the introduction, installation and welding of the plugs are being carried out.

Figures 3A, 3B, 3C, 3D:
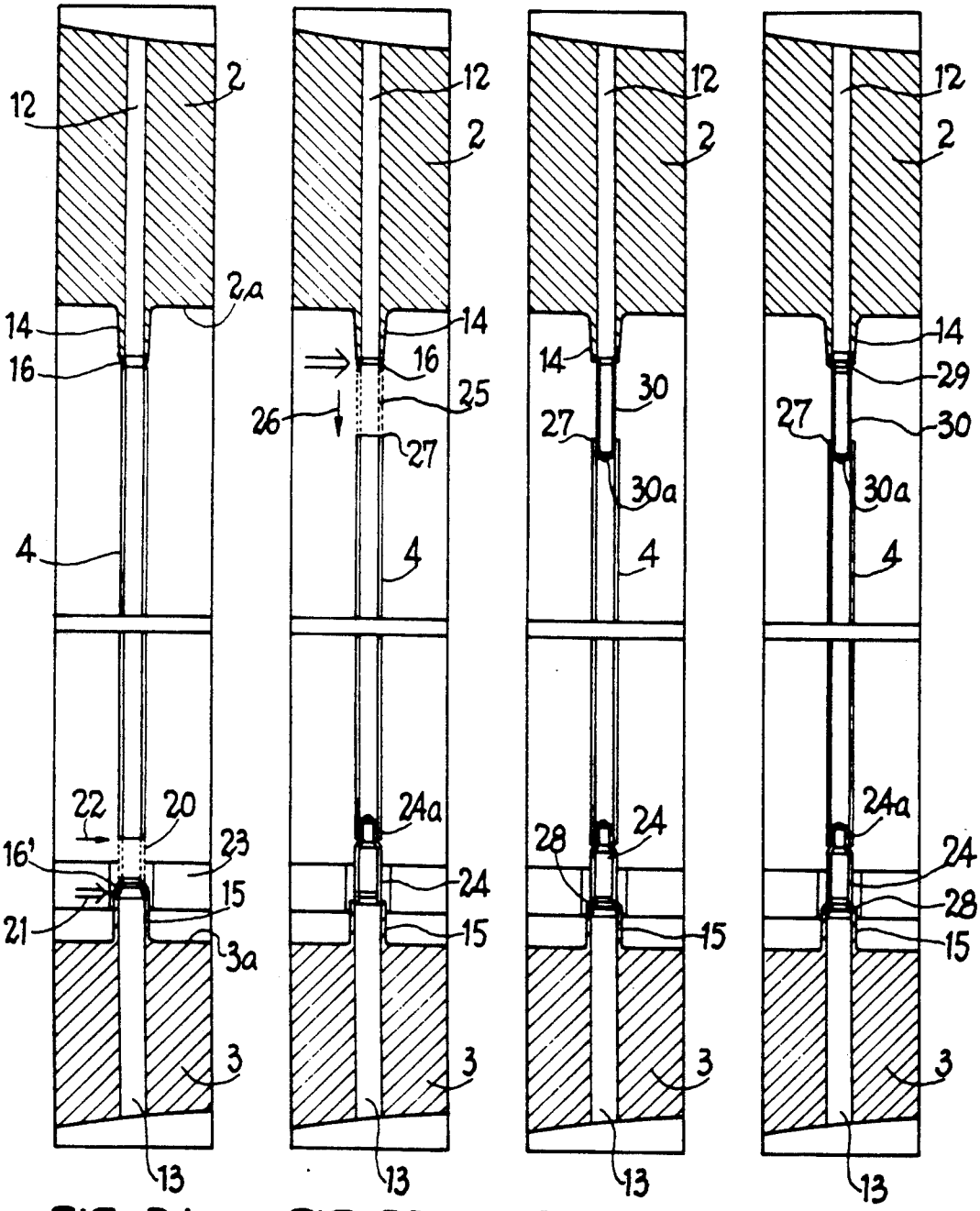
FIGS. 3A, 3B, 3C and 3D are sectional views showing different successive steps for carrying out the process according to the invention in a first embodiment of the invention.

In a first stage, as can be seen in FIG. 3A, of a portion 20 of the tube 4 located in its lower part in the vicinity of the nipple 15 projecting relative to the inner face 3*a* of the tube plate 3 is cut.

The cutting of the portion 20 is performed from inside the tube 4 by the use of a device of known type, such as is described in patent application FR-A-2,613,961, filed Apr. 17, 1987. The cutting device comprises a milling cutter fastened to the end of an axle allowing it to be set in rotation and introduced into the tube from the outer face of the plate 3 in order to position it in the region of the zones to be cut from inside the tube. The axle of the milling cutter makes it possible to displace it in the radial direction, so as to ensure that the milling cutter penetrates into the metal during machining.

The cutting of the portion 20 of the tube is executed by making two transverse cuts 21 and 22. The cut 21 is made in the junction zone 16' of the tube 4 with the nipple 15 projecting relative to the face 3*a* of the tube plate 3. The cut 21 made by milling makes it possible to eliminate the metal of the frustoconical junction part 16', of tube 4 with the nipple 15 of the tube plate 3. The metal of the junction zone 16' is eliminated in the form of filings, chips or cut particles which are extracted from the steam generator through the orifice 13 of the tube plate 3.

The cut 22 is made in a zone of the tube 4 located in its lower part and above the first spacer plate 23 for the retention of the tubes of the bundle.

When the cuts 21 and 22 have been made, the tube portion 20 is extracted through orifice 13 of the tube plate 3.

As can be seen in FIG. 3B, a lower plug 24 of tubular shape having one end 24*a* closed by a sealing bottom is introduced through orifice 13 of the tube plate 3, so that the end 24*a* of the plug 24 is inserted into the lower end of the tube 4, the cutting of which was carried out previously.

Figure 6:
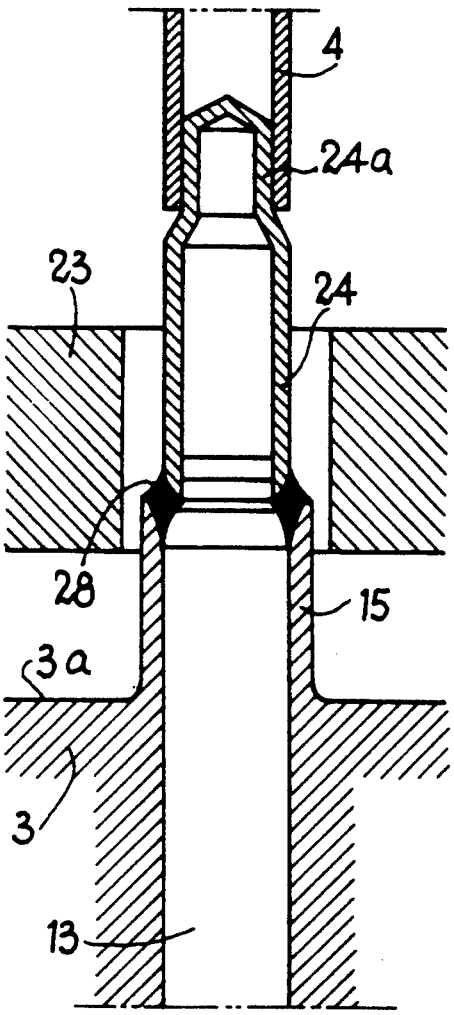
FIG. 6 is a large-scale sectional view of a plug installed at the lower end of a tube of the steam generator, on the same side as the water box.

As can be seen in FIGS. 3B, 3C and 3D and in FIG. 6, the plug 24 comprises a tubular body, of which the diameter, substantially identical to the diameter of the tube 4, is smaller than the size of the bore of the branch 15 and of the orifice 13 of the plate 3.

The end part 24*a* of the plug 24 has a diameter very slightly smaller than the diameter of the tube 4, so that the end 24*a* of the plug can be engaged freely into the tube.

The end of the plug 24 opposite its end 24*a* engaged in the tube is located in the region of the end of the nipple 15, on which the fastening of the plug 24 by means of weld spots is executed from inside the orifice 13 of the tube plate.

The tube 4 is thus maintained in place in its lower part by the plug 24.

By engaging a cutting tool comprising a milling cutter, as described above, into the orifice 12, a cut of the end of the tube 4 at the junction zone 16 of this tube with the nipple 14 of the tube plate 2 is made from outside the tube plate 2. The machining of the tube and of the end of the nipple 14 is performed in such a way as to eliminate all the metal at the junction zone 16 in the form of filings or chips. The filings, chips or metal particles formed during machining are recovered so as to avoid polluting the interior of the steam generator.

The machining of the tube 4 is continued by displacing the milling cutter in the direction of the arrow 26, so as to eliminate a tube portion 25 in the form of milling filings or chips which are recovered outside the steam generator.

The tube 4, the lower part of which is retained in the steam generator means of the plug 24, has a free upper end 27 after machining.

As can be seen in FIG. 3C, a plug 30 of tubular shape having an outside diameter slightly smaller than the inside diameter of the tube 4 and an end part 30*a*closed by a sealing bottom is subsequently engaged into the orifice 12 of the tube plate 2 in such a way as to introduce the closed end 30*a* of the plug 30 into the upper end 27 of the tube 4.

The end of the plug 30 opposite the closed end 30*a* is placed level with the end part of the nipple 14 of the tube plate 2. The plug 30 is fixed in place inside the nipple 14 by means of weld spots.

A continuous sealing weld 28 is thereafter made between the end of the plug 24 and the end of the nipple 15, the weld zone 28 having a substantially frustoconical shape.

As can be seen in FIG. 3D, the fastening of the upper plug 30 is subsequently completed by a continuous annular sealing weld 29 making the junction between the plug 30 and the end of the nipple 15.

The sealing plugging of the defective tube 4 has thus been executed, the inner space of the tube 4 and the inner volume of the steam generator being isolated completely sealingly relative to the water box and relative to the steam collector by means of the plugs 24 and 30 attached to the inner part of the tube plates 3 and 2, respectively.

Moreover, the defective tube 4 is held in place, thereby obviating the need to modifying the thermohydraulic conditions of the steam generator in the vicinity of the defective tube 4.

Furthermore, the plugs 24 and 30 are engaged with their end parts 24*b* and 30*a* completely freely inside the ends of the tube 4.

Because the plugs 24 and 30 are not connected to the ends of the tube 4, these ends are capable of sliding on the end parts 30*a* and 24*a* of these plugs in the longitudinal direction, for example when the tube 4 experiences expansions or contractions of thermal origin in the operating generator.

This prevents any buckling of the defective tube 4 retained in the steam generator after plugging.

A second embodiment of the plugging process according to the invention will now be described with to FIGS. 4A, 4B, 4C and 4D, the elements of which bear the same reference numerals as those of the corresponding elements in FIGS. 3A to 3D.

The first phase in carrying out the process according to the second embodiment makes it possible to carry out the cutting of a portion 20' lower part of tube 4 in an identical way to the cutting of the portion 20 during the first phase of the first embodiment of the plugging process according to the invention.

The cutting of the portion 20' is executed by the milling of the junction zone 16' and of the wall of the tube 4 in respective cutting zones 21' and 22'.

The metal of the junction zone 16, is eliminated in the manner described for the first embodiment, and an additional cut of the tube is made in the cutting zone 22'.

The cutting zone 22' is located at a greater distance from the inner surface 3*a* of the tube plate 3 than the cutting zone 22 employed in the first embodiment of the process, i.e., in an arrangement located towards the inside of the steam generator in relation to the zone 22.

Figures 4A, 4B, 4C, 4D:
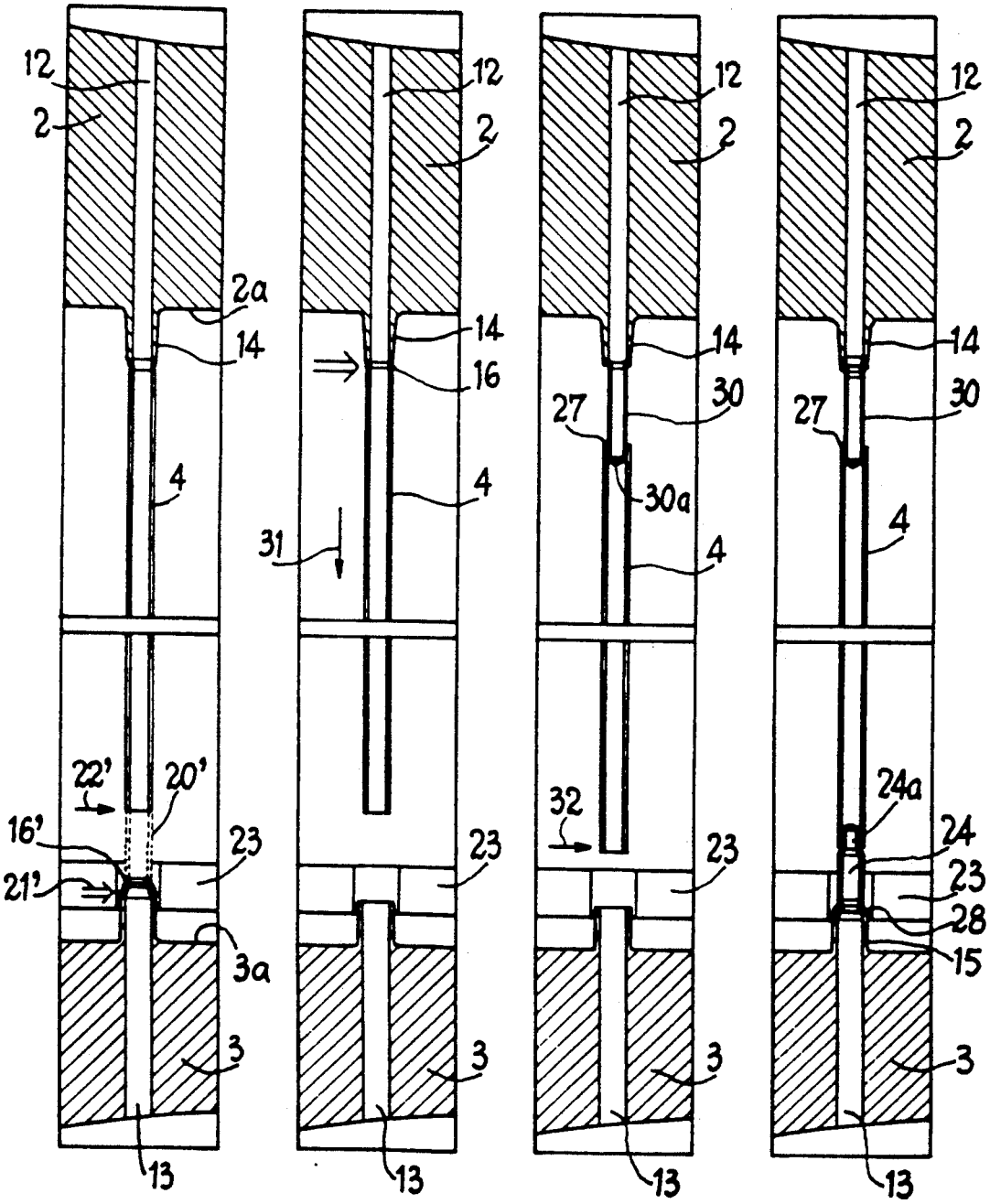
FIGS. 4A, 4B, 4C and 4D are sectional views showing different successive steps in carrying out the process according to a second embodiment of the invention.

As can be seen in FIG. 4B, in a second phase, the cutting and elimination by machining of the junction zone 16 of the tube 4 with the nipple 14 of the tube plate 2 is carried out from inside the tube, the previously cut lower part of the tube being held by a tool engaged and clamped inside the tube 4.

After the cutting of the tube by the machining of the junction zone 16 has been executed, the tube is displaced downwards, as represented by the arrow 31, by the use of the tool engaged in the lower part of the tube 4.

As shown in FIG. 4C, the tube 4 is displaced downwards in such a way that its upper end 27 is at a distance from the end of the nipple 14 corresponding substantially to the length of the tube portion 25 eliminated by machining in the first embodiment.

A tubular plug 30 closed at one 30*a* of its ends is engaged into the orifice 12, in such a way that the end 30*a* of the plug 30 is engaged freely in the upper end part of the tube 4 and the end of the plug 30 opposite its end 30*a* coincides with the end part of the nipple 14.

The plug 30 is fastened inside the nipple 14 by means of weld spots.

The tube 4 is thus maintained in place inside the steam generator by the upper plug 30 and by the tool which is engaged in its lower part and which can consist of an assembly for the centering and guidance of the cutting device.

A cut to length of the lower part of the tube is then made along the cutting line denoted by the arrow 32 in FIG. 4C.

As can be seen in FIG. 4D, a plug 24 similar to the lower plug described in the first embodiment and illustrated in FIG. 6 is introduced into the lower part of the tube 4.

The plug 24 comprises an end part 24*a* engaged freely in the end of the tube 4 previously recut to the desired length. The plug 24 is fixed in place by means of weld spots, and then a continuous annular sealing weld 28 is made at the end of the plug 24 opposite its end 24*a* engaged in the tube 4.

The weld 28 is made on the end part of the plug 24 coinciding with the end of the nipple 15.

In the final phase, the plugs 24 and 30 are fastened to the nipples 15 and 14 and engaged into the ends of the tube 4, thereby making it possible to obtain the same advantages with regard to the effectiveness of the plugging and the possibilities of longitudinal expansion of the tube as in the first embodiment.

Figure 5:
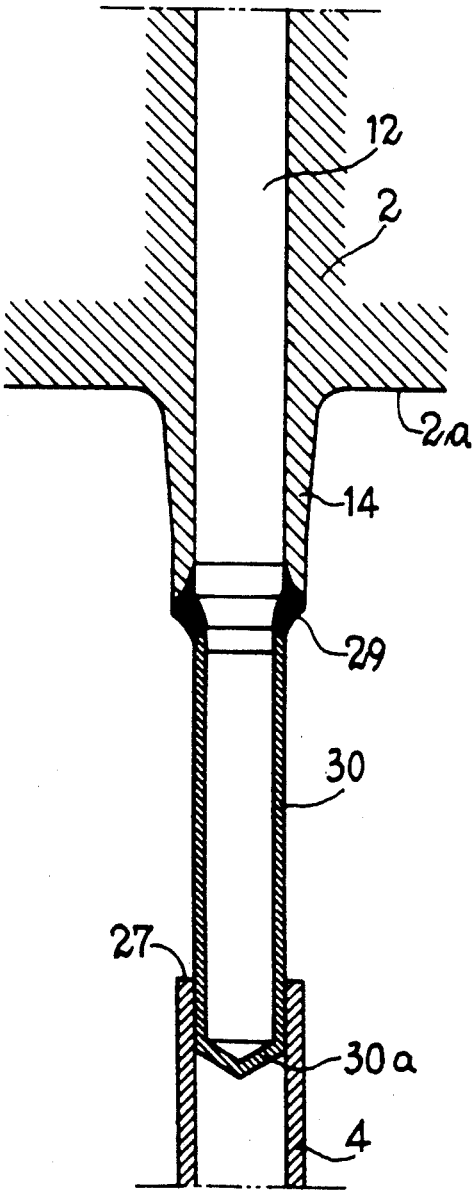
FIG. 5 is a large-scale sectional view of a plug installed by the process according to the invention at the upper end of a tube, on the same side as the steam collector.

FIGS. 5 and 6 illustrate on a larger scale the plugs 30 and 24 for shutting off the orifices 12 and 13 of the tube plates 2 and 3, respectively, the plugs 30 and 24 having respective ends 30*a* and 24*a* engaged freely inside the ends of the defective tube 4.

The sealing of the welded junction zones 29 and 28, which makes it possible to prevent any leak of steam or water inside the steam generator in which circulates the liquid sodium constituting the heat-exchange fluid of the steam generator, is ensured insofar as the welded zones have no defect.

When the plugs 24 and 30 have been fastened to the nipples 15 and 14 of the steam generator by welding, it is necessary to conduct a check of each of the welds 28 and 29. This check can be made either ultrasonically or by radiography.

Figure 7:
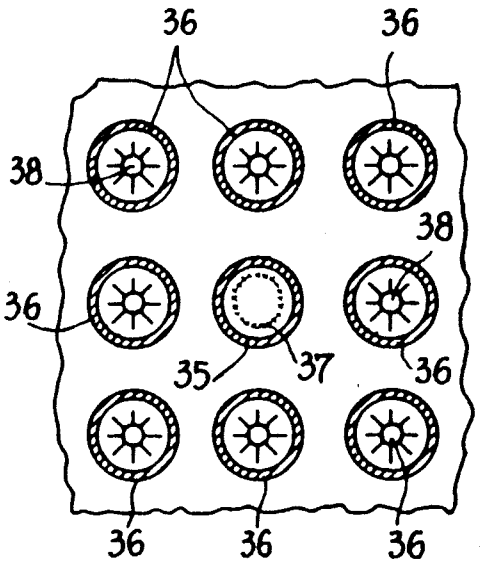
FIG. 7 is a cross-sectional view of various tubes of the bundle of a steam generator during an operation to check the welds of a plug installed inside a defective tube.

FIG. 7 illustrates a tubular plug 35 which can consist either of a lower plug, such as the plug 24 shown in FIG. 6, or of an upper plug, such as the plug 30 shown in FIG. 5, the plug 35 being associated with the lower part or with the upper part of a defective tube 4, the plugging of which has been ensured. FIG. 7 also illustrates the eight tubes 36 of the bundle of the steam generator surrounding the defective tube, the plugging of which has been carried out. The cross-sections of the tubes 36 of the bundle of the steam generator are arranged according to a square-mesh network where each of the tubes is surrounded by eight tubes in adjacent arrangements. If the check of the junction weld of the plug 35 is to be conducted by radiography, a film 37 sensitive to X-rays is introduced into the plug 35 level with the weld joining this plug to the corresponding nipple of the steam generator.

A radiation source 38 is arranged in each of the eight tubes 36, so as to carry out the radiography of the weld and plug zones and of the nipple adjacent to the welded zone by the transmission of radiation generated by the sources 38 through the weld or the wall of the plug 35 or of the corresponding nipple and by a printing of the sensitive film 37.

The film 37 is subsequently extracted from the plug 35, developed and analyzed to determine the quality of the weld made. The quality of the sealing welds of the plugs for shutting off the defective tube can thus be guaranteed.

The process according to the invention makes it possible in a simple way to carry out an extremely effective and extremely reliable plugging of a defective tube, while at the same time keeping the tube in place inside the steam generator.

This avoids modifying the thermohydraulic operating conditions of the steam generator in the vicinity of the defective tube.

Moreover, the tube held in place in the steam generator can expand and contract freely by displacement in the axial direction in relation to the plug.

The cutting and machining making it possible to eliminate the weld zones and part of the tube can be carried out in a way different from that described and by the use of a tool other than a milling cutter.

During the operations of replacing the tube, the inner space of the heat exchanger arranged around the tubes of the bundle can be filled with a protective gas of any kind, such as an inert gas or a neutral gas, making it possible particularly to protect the outside of the welding zones.

In the case of a steam generator, the primary fluid of which consists of a reactive liquid metal, such as liquid sodium, the filling of the central part of the steam generator containing the liquid sodium during the normal operation of the reactor with an inert gas after the emptying of the liquid sodium makes it possible to prevent any risk that an oxidizing gas will come into contact with the sodium deposits liable to remain in the central part of the steam generator.

Finally, the process according to the invention can be used for carrying out the replacement of one or more tubes of a heat exchanger with straight or virtually straight tubes which is different from a steam generator of a fast-neutron nuclear reactor cooled by liquid sodium.

The process according to the invention is used for any heat exchanger with straight or virtually straight tubes which comprises two substantially parallel tube plates which are distant from one another and through which pass orifices in the region of which the tubes are fastened at their ends.

We claim:

1. A process for plugging a tube of a straight-tube heat exchange having two tube plates which are substantially parallel and distant from one another, and through which pass orifices in the region of which the tubes are fastened in junction zones with their ends welded to connecting branches of the tube plates, each of the tubes of the bundle of the heat exchanger being fastened at one of its ends to a first branch of a first tube plate and at its other end to a second branch of a second tube plate, said process comprising the steps of (a) cutting the tube at its ends adjacent to the first and to the second branch, eliminating metal of the junction zones of the tube with each of the branches from inside the tube and through one of the tube plates;

(b) cutting and eliminating at least one portion of the tube adjacent to at least one of the branches;

(c) introducing into each of the ends of the tube in place inside the heat exchanger a plug of tubular shape, the diameter of said plug being smaller than the inside diameter of the tube, so that the plug has a closed end inside the tube and an opposite end arranged inside the corresponding branch;

(d) fixing the plugs in place in the branches with a continuous sealing weld between each of the plugs and the corresponding branch, wherein the tubes have freedom of longitudinal movement relative to the plugs.

2. The process as claimed in claim 1, wherein the inside diameter of at least one of the branches or second branch and of the corresponding orifice of said second tube plate is substantially larger than the outside diameter of the tube which is connected to the second branch by means of a junction zone of substantially frustoconical shape, comprising the steps of (a) cutting and extracting a portion of the tube adjacent to said second branch;

(b) introducing a first plug via an orifice of said second tube plate opening into said second branch, in such a way as to insert a closed end of said first plug into the end of the cut-off tube adjacent to said second branch, and fastening said first plug in said second branch by means of weld spots;

(c) cutting the tube in the junction zone with said first branch and eliminating the material of the tube in the junction zone and over a portion of the tube arranged in the extension of the junction zone;

(d) introducing a second plug of tubular shape via an orifice of said first tube plate, in such a way that a closed end of said second plug is engaged into the free end of the tube remaining in place in the steam generator after elimination of the portion and fastening said second plug inside said first branch by means of weld spots; and (e) making continuous annular sealing welds inside said first and second branches to connect the plugs with corresponding branches.

3. The process as claimed in claim 1, wherein the inside diameter of at least one of the branches or second branch and of the corresponding orifice of the second tube plate is substantially larger than the outside diameter of the tube which is connected to the second branch by means of a junction zone of substantially frustoconical shape, comprising the steps of (a) cutting and extracting a portion of the tube adjacent to said second branch from inside the tube and through said second tube plate;

(b) cutting the tube in the vicinity of said first branch of said first tube plate and eliminating the junction zone between said first branch and the end of the tube;

(c) displacing the tube in the axial direction within the steam generator in the direction of said second branch of said second tube plate;

(d) introducing a first plug of tubular shape via an orifice of said first tube plate, in such a way that a closed end of said first plug is inserted into the end, adjacent to said first branch of the tube of which the cutting and displacement were previously carried out, and fastening said first plug inside the branch by means of weld spots;

(e) cutting to length the end of the tube adjacent to said second branch, (f) introducing a second plug of tubular shape via the orifice of the said second tube plate, in such a way that a closed end of said second plug is inserted freely into said second end of the tube, the cutting to length of which has been carried out, and fastening said second plug inside said second branch by means of weld spots; and (g) making continuous annular sealing welds inside said first and second branches to connect the plugs with the corresponding branches.

4. The process as claimed in any one of claim 1 to 3, comprising establishing a neutral gas atmosphere around the tube during all operations of plugging the tube with plugs.

5. The process as claimed in claim 4, in respect of a heat exchanger comprising a bundle of tubes surrounded by a casing fastened to the tube plates, comprising filling the casing of the heat exchanger with neutral gas during replacement of a tube of the bundle.

6. The process as claimed in any one of claim 1 to 3, comprising, after continuous welding between the plugs and the corresponding branches, the step of conducting a radiographic check of the welds of each of the plugs by introducing a film into the plug, level with the weld, and X-ray sources into tubes of the bundle of the steam generator, these sources being arranged adjacent to the tubes the plugging of which has been carried out.

7. The process as claimed in any one of claims 1 to 3, for plugging a steam-generator tube of a fast-neutron nuclear reactor cooled by liquid sodium.

* * * * *